US010089945B2

(12) United States Patent
Kim et al.

(10) Patent No.: US 10,089,945 B2
(45) Date of Patent: Oct. 2, 2018

(54) DISPLAY DRIVING CIRCUIT AND DISPLAY DEVICE

(71) Applicant: SILICON WORKS CO., LTD., Daejeon-si (KR)

(72) Inventors: Myung Yu Kim, Daejeon-si (KR); Soo Woo Kim, Daejeon-si (KR); An Young Kim, Daejeon-si (KR)

(73) Assignee: SILICON WORKS CO., LTD., Daejeon-si (KR)

( * ) Notice: Subject to any disclaimer, the term of this patent is extended or adjusted under 35 U.S.C. 154(b) by 63 days.

(21) Appl. No.: 14/312,968

(22) Filed: Jun. 24, 2014

(65) Prior Publication Data

US 2014/0375536 A1 Dec. 25, 2014

(30) Foreign Application Priority Data

Jun. 25, 2013 (KR) ..... 10-2013-0073300

(51) Int. Cl.
*G09G 3/36* (2006.01)

(52) U.S. Cl.
CPC ... *G09G 3/3614* (2013.01); *G09G 2310/0289* (2013.01); *G09G 2330/08* (2013.01)

(58) Field of Classification Search
CPC ..... G09G 5/00; G09G 2310/0289; G09G 3/36
See application file for complete search history.

(56) References Cited

U.S. PATENT DOCUMENTS 5,897,228 A * 4/1999 Schrock ..... G03B 17/24 396/297
7,378,879 B1 * 5/2008 De La Cruz ..... H03K 19/17728 326/105
2007/0171169 A1 * 7/2007 Hirama ..... G09G 3/3685 345/94
2008/0218500 A1 * 9/2008 Akai ..... G09G 3/3688 345/205
2011/0310080 A1 * 12/2011 Tonomura ..... 345/211
2014/0184483 A1 * 7/2014 Jung ..... G09G 3/3688 345/87

* cited by examiner

*Primary Examiner* — Michael J Jansen, II
*Assistant Examiner* — Paras D Karki
(74) *Attorney, Agent, or Firm* — Kile Park Reed & Houtteman PLLC

(57) ABSTRACT

A display driving circuit is configured to select one of application of a pair of pixel driving signals to a pair of output terminals and charge sharing between the pair of output terminals by using charges discharged from a display panel.

9 Claims, 4 Drawing Sheets a)

b)

(a)

(b)

DISPLAY DRIVING CIRCUIT AND DISPLAY DEVICE

BACKGROUND

1. Technical Field

The present disclosure relates to a display driving technology, and more particularly, to a display driving circuit which is improved to have stability in correspondence to power bouncing and a display device which adopts the display driving circuit.

2. Related Art

A conventional display driving circuit selectively supplies buffered pixel driving signals to output terminals according to an inversion (or polarity inversion) driving scheme. Also, in order to reduce power consumed to buffer the pixel driving signals, the conventional display driving circuit interconnects output terminals for a time during which the pixel driving signals are not applied to a display, and thereby preliminarily drives an output voltage to an intermediate potential.

The conventional display driving circuit includes a plurality of switches for selectively supplying the pixel driving signals to the output terminals or interconnecting the output terminals, and a circuit for controlling the switches. Moreover, the conventional display driving circuit includes level shifters for level-shifting control signals of a low voltage region into control signals of a high voltage region, to appropriately control switches operating in the high voltage region.

FIG. 1 is an exemplary diagram showing the configuration and operations of a level shifter 100 in a conventional display driving circuit.

Referring to (a) of FIG. 1, the level shifter 100 outputs control signals of a high voltage region in correspondence to control signals of a low voltage region. In FIG. 1, a first voltage of the high voltage region is designated by VDD and a second voltage of the high voltage region is designated by VSSH, and a third voltage of the low voltage region is designated by VCC and a fourth voltage of the low voltage region is designated by VSS. The first voltage VDD and the third voltage VCC are used as driving voltages, and the second voltage VSSH and the fourth voltage VSS are used as ground voltages.

The level shifter 100 includes a PMOS network and NMOS transistors M1 and M2. The NMOS transistors M1 and M2 are connected in parallel to the PMOS network. The PMOS network may have, for example, a structure in which PMOS transistors are cross-coupled. The PMOS network and the NMOS transistors M1 and M2 are driven using the first voltage VDD and the second voltage VSSH of the high voltage region.

The control signals driven by the third voltage VCC and the fourth voltage VSS of the low voltage region are applied to the gates of the NMOS transistors M1 and M2. The level shifter 100 outputs control signals SW1 and SW2 of the high voltage region in correspondence to the control signals of the low voltage region.

As described above, the level shifter 100 is driven in the low voltage region, level-shifts the control signals inputted to the NMOS transistors M1 and M2, to the high voltage region, and outputs the control signals SW1 and SW2 of the high voltage region. The level shifter 100 operates by potential differences between the second voltage VSSH and the gates of the NMOS transistors M1 and M2. The potential differences between the gates of the NMOS transistors M1 and M2 and the second voltage VSSH may be designated by VGS, and the threshold voltages of the NMOS transistors M1 and M2 may be designated by VTH.

In detail, the level shifter 100 operates normally when VGS−VTH>0, and does not operate when VGS−VTH<0. In the case where the level shifter 100 does not operate, the control signals SW1 and SW2 outputted from the level shifter 100 become unknown states. In other words, the control signals SW1 and SW2 outputted from the level shifter 100 may correspond to random values regardless of inputs thereto.

In (b) of FIG. 1, the left represents the case where the level shifter 100 operates normally, and the right represents the case where the level shifter 100 operates abnormally.

The conventional display driving circuit has a problem in that the second voltage VSSH related with the control signals bounces as driving current flows by passing through bonding resistance and LOG (line of glass) resistance.

Even though the second voltage VSSH bounces, if the second voltage VSSH bounces to have a potential which is lower by at least a predetermined magnitude than the third voltage VCC of the low voltage region, the level shifter 100 may operate normally. However, if the second voltage VSSH bounces to a level corresponding to VGS−VTH<0, the level shifter 100 operates abnormally.

As a result, the abnormal operation of the level shifter 100 causes the misoperation of the switches included in the display driving circuit, and accordingly, an internal short current path is likely to be formed in the display driving circuit. In this case, the display driving circuit enters an abnormal state, retains the corresponding state, and outputs abnormally the pixel driving signals. Also, the internal short current path may serve as a factor for heat dissipation of the display driving circuit.

SUMMARY

An embodiment is directed to a display driving circuit capable of normally outputting pixel driving signals even when power bouncing occurs.

Also, an embodiment is directed to a display driving circuit which prevents the occurrence of a case where switches used for outputting pixel driving signals misoperate, thereby suppressing power consumption and heat dissipation due to the misoperation.

In an embodiment, a display driving circuit forces selection of one of application of a pair of pixel driving signals to a pair of output terminals and charge sharing between the pair of output terminals by using charges discharged from a display panel, upon occurrence of power bouncing.

The display driving circuit may include an output switch unit configured to directly or crossly transmit buffered pixel driving signals to the pair of output terminals; a charge sharing switch unit configured to connect the pair of output terminals with each other; and a switch misoperation prevention unit configured to force exclusive operations of the output switch unit and the charge sharing switch unit with respect to each other to prevent formation of a short current path.

The display driving circuit may further include a control unit configured to generate control signals for controlling operations of the output switch unit and the charge sharing switch unit, wherein the switch misoperation prevention unit may process the control signals and provide resultant signals to the output switch unit and the charge sharing switch unit.

The control unit may include level shifters configured to amplify and output the control signals.

The output switch unit may include direct switches configured to directly connect the pair of pixel driving signals to the pair of output terminals and cross switches configured to crossly connect the pair of pixel driving signals to the pair of output terminals, the charge sharing switch unit may include a charge sharing switch configured to connect the pair of output terminals with each other, the control unit may generate first to third control signals for respectively controlling operations of the direct switches, the cross switches and the charge sharing switch, and the switch misoperation prevention unit may process the first to third control signals through an exclusive OR (XOR) operation.

The switch misoperation prevention unit may afford priorities from the first control signal to the third control signal, and may determine only one control signal with a higher priority as a switch turn-on signal through the XOR operation.

The switch misoperation prevention unit may output a fourth control signal by bypassing the first control signal, may output a fifth control signal for controlling the cross switches by NOTing the second control signal and NORing a result of NOTing the second control signal and the first control signal, and may output a sixth control signal for controlling the charge sharing switch by NOTing the third control signal and NORing a result of NOTing the third control signal and the fourth and fifth control signals.

Each of the direct switches, the cross switches and the charge sharing switch may be realized by a MOS transistor.

The switch misoperation prevention unit may further generate inversed signals of the fourth to sixth control signals, and may provide the inversed signals to the direct switches, the cross switches and the charge sharing switch.

The display driving circuit may further include an output buffer unit configured to buffer pixel signals.

In an embodiment, a display driving circuit includes a display panel and a display driving circuit for driving the display panel, wherein the display driving circuit forces selection of one of application of a pair of pixel driving signals to a pair of output terminals and charge sharing between the pair of output terminals by using charges discharged from a display panel, upon occurrence of power bouncing.

The disclosed technology may have the following effects. However, since it is not meant that a specific embodiment should include all the following effects or should include only the following effects, the scope of protection of the disclosed technology should not be construed to be limited by the following effects.

The display driving circuit according to the embodiments may normally output pixel driving signals to a display through a switch misoperation prevention unit even when power bouncing occurs.

The display driving circuit according to the embodiments may prevent the formation of an internal short current path, thereby decreasing power consumption and heat dissipation due to power noise.

DETAILED DESCRIPTION

Figure 1:
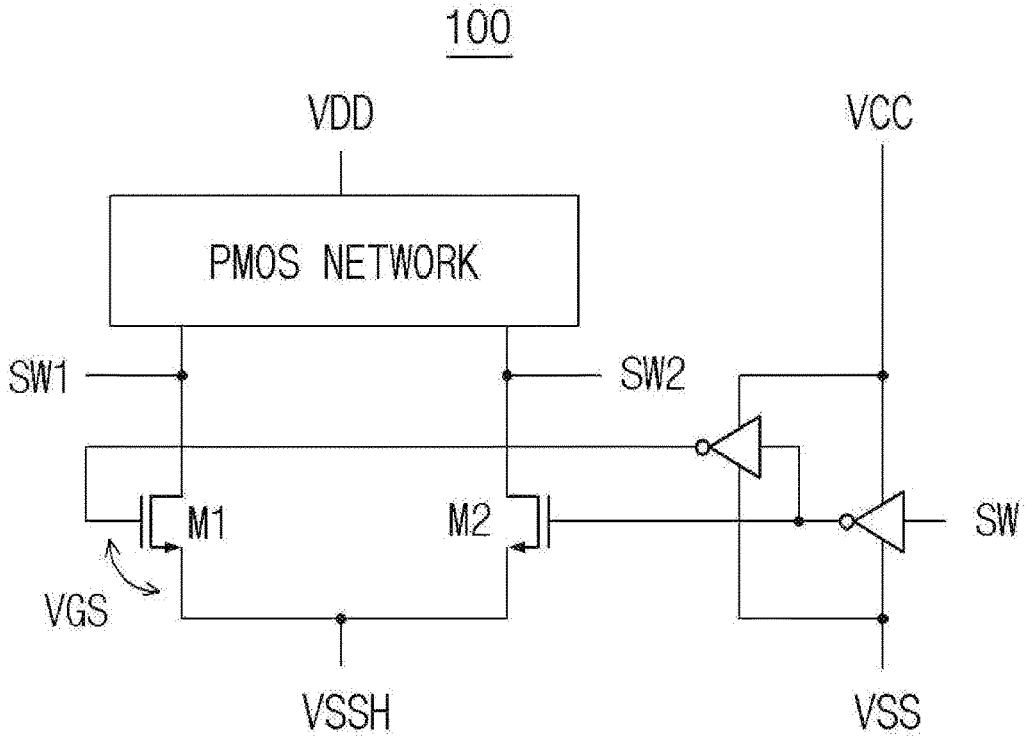
Fig. 1 (PRIOR ART)
FIG. 1 is an exemplary diagram showing the configuration and operations of a level shifter in a conventional display driving circuit.
Figure 1:
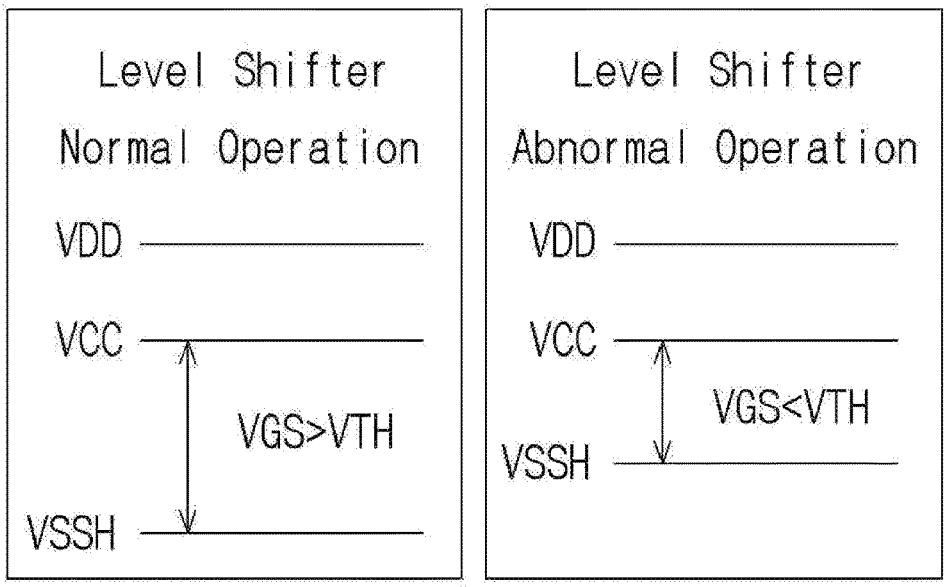
Fig. 1 (PRIOR ART)

Exemplary embodiments will be described below in more detail with reference to the accompanying drawings. The disclosure may, however, be embodied in different forms and should not be constructed as limited to the embodiments set forth herein. Rather, these embodiments are provided so that this disclosure will be thorough and complete, and will fully convey the scope of the disclosure to those skilled in the art. Throughout the disclosure, like reference numerals refer to like parts throughout the various figures and embodiments of the disclosure.

Since the following descriptions for an embodiment are nothing but an illustration for explaining structural and functional aspects of the disclosure, the scope of protection of the disclosure should not be construed to be limited to the embodiment set forth herein.

The meanings of the terms used in the embodiment of the disclosure should be understood as follows.

The terms such as "first", "second", and so forth are to distinguish certain components from other components.

When it is mentioned that a certain component is "connected" to another component, although the former may be directly connected to the latter, it should be understood that a third component may exist between them. On the other hand, when it is mentioned that a certain component is "directly connected" to another component, it should be understood that a third component does not exist between them. Other expressions describing relationships among components such as "between", "immediately between", "adjacent to" and "directly adjacent to" should be understood in the same way.

The terms of a singular form may include plural forms unless clearly referred to otherwise in context. In this disclosure, it should be understood that the terms such as "include" and "have" are intended to specify that there are features, figures, steps, operations, components, parts or their combinations represented in the specification and not to exclude in advance the possibilities of one or more other features, figures, steps, operations, components, parts or their combinations to exist or be added.

A display device includes a display panel and a display driving circuit for driving the display panel.

Figure 2:
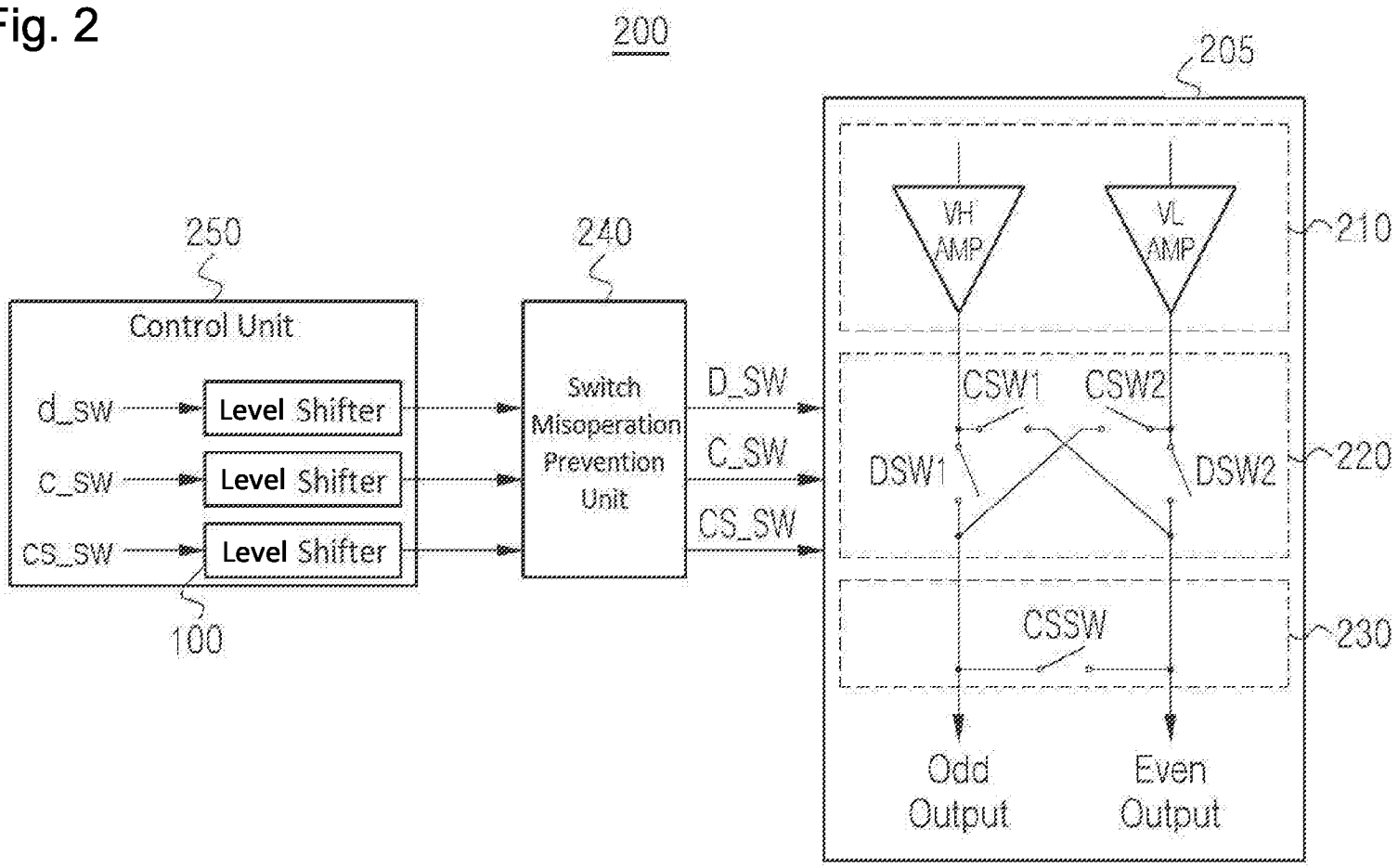
FIG. 2 is a diagram showing a display driving circuit in accordance with an embodiment.

FIG. 2 is a diagram showing a display driving circuit in accordance with an embodiment.

Referring to FIG. 2, a display driving circuit 200 includes an output circuit 205, a switch misoperation prevention unit 240, and a control unit 250. The output circuit 205 includes a output buffer unit 210, an output switch unit 220, and a charge sharing switch unit 230.

The display driving circuit 200 may be realized as an IC and may be mounted to a display panel (not shown). In particular, the display driving circuit 200 may correspond to a COG (chip-on-glass) type IC, and may be mounted by being directly bonded to a substrate glass.

The output circuit 205 is to provide pixel driving signals to the display panel, and provides a pair of pixel driving signals with different polarities according to an inversion driving scheme.

The output buffer unit 210 includes a pair of output buffers VH AMP and VL AMP which buffer and output the pair of pixel driving signals. The pair of output buffers VH AMP and VL AMP include a first output buffer VH AMP which has a first voltage driving potential and a second output buffer VL AMP which has a second voltage driving potential. The first and second output buffers VH AMP and VL AMP may be referred to as a positive (+ or VH) buffer and a negative (− or VL) buffer, respectively. The first voltage driving potential may correspond to a range that is equal to or higher than the second voltage driving potential.

In an embodiment, the first and second output buffers VH AMP and VL AMP may be realized as unity gain buffers or amplifiers.

The output switch unit 220 may selectively connect the first output buffer VH AMP to a first output terminal Odd Output which corresponds to an odd column of a display or a second output terminal Even Output which corresponds to an even column of the display. Further, the output switch unit 220 may selectively connect the second output buffer VL AMP to the second output terminal Even Output or the first output terminal Odd Output.

The output switch unit 220 may correspond to a polarity inversion switching circuit for transmitting the output of the output buffer unit 210 to the display panel and preventing misoperation of display crystals.

The output switch unit 220 includes one or more switches which are positioned between and electrically connected to the output buffer unit 210 and the output terminals Odd Output and Even Output and which may be selectively connected to the output terminals Odd Output and Even Output according to control signals.

In an embodiment, the output switch unit 220 may include direct switches which transmit pixel driving signals directly to the pair of output terminals Odd Output and Even Output, and cross switches which transmit pixel driving signals crossly to the pair of output terminals Odd Output and Even Output.

Referring to FIG. 2, the output switch unit 220 may include a first switch DSW1 which is connected to the first output buffer VH AMP and may be connected to the first output terminal Odd Output, a second switch CSW1 which is connected to the first output buffer VH AMP and may be connected to the second output terminal Even Output, a third switch CSW2 which is connected to the second output buffer VL AMP and may be connected to the first output terminal Odd Output, and a fourth switch DSW2 which is connected to the second output buffer VL AMP and may be connected to the second output terminal Even Output. The first switch DSW1 and the fourth switch DSW2 correspond to the direct switches, and the second switch CSW1 and the third switch CSW2 correspond to the cross switches.

In the output switch unit 220 of an embodiment, any one of a direct switch and a cross switch is turned on during a panel charge/discharge period in which pixel driving signals are transmitted to the display panel, and a direct switch and a cross switch is turned off during a charge sharing period in which the output terminals Odd Output and Even Output are connected with each other to reduce the power consumption of the display driving circuit 200. In relation to inversion of the polarities of pixels, the output switch unit 220 may change the polarities of pixels from positive (+) to negative (−) or from negative (−) to positive (+) two times in each frame. To this end, the output switch unit 220 may alternately operate the direct switches and the cross switches.

The charge sharing switch unit 230 connects the pair of output terminals Odd Output and Even Output with each other. In detail, the charge sharing switch unit 230 includes at least one charge sharing switch, and may connect or disconnect the first and second output terminals Odd Output and Even Output to and from each other.

The charge sharing switch unit 230 connects the first and second output terminals Odd Output and Even Output to each other during the charge sharing period. According to the operation of the charge sharing switch unit 230, the pair of output terminals Odd Output and Even Output may share charges and thereby reduce the power consumption of the display driving circuit 200.

In the charge sharing period, a charge sharing switch CSSW in the charge sharing switch unit 230 is turned on and connects the respective output terminals Odd Output and Even Output with each other. The respective output terminals Odd Output and Even Output share the charges discharged from the display panel, through the charge sharing switch unit 230, and retain the same potential.

The control unit 250 controls the respective operations of the output switch unit 220 and the charge sharing switch unit 230.

In detail, the control unit 250 may control the respective operations of the output switch unit 220 and the charge sharing switch unit 230, based on passage of a time (for example, the charge sharing period and the panel charge/discharge period) and whether polarities are inverted or not.

In an embodiment, the control unit 250 may generate first to third control signals d_sw, c_sw and cs_sw for controlling the respective operations of the direct switches DSW1 and DSW2, the cross switches CSW1 and CSW2 and the charge sharing switch CSSW.

The control unit 250 may turn on the direct switches DSW1 and DSW2 during the panel charge/discharge period and may turn off the direct switches DSW1 and DSW2 during the charge sharing period, by using the first control signal d_sw.

Similarly, the control unit 250 may control the respective operations of the cross switches CSW1 and CSW2 and the charge sharing switch CSSW by using the second and third control signals c_sw and cs_sw, as described above.

The control unit 250 may be realized as a multiplexer which outputs various signals from a single signal.

In an embodiment, the control unit 250 may include level shifters 100 which convert control signals of a low voltage region into control signals of a high voltage region and output resultant signals.

The level shifters 100 may shift the first to third control signals d_sw, c_sw and cs_sw to be outputted from the control unit 250, to levels, respectively, capable of controlling the output switch unit 220 and the charge sharing switch unit 230.

Since the level shifters 100 may be configured as shown in FIG. 1, repeated descriptions thereof will be omitted herein.

The switch misoperation prevention unit 240 prevents the formation of a short current path by the output switch unit 220 and the charge sharing switch unit 230. The short current path corresponds to a path which is formed as the output switch unit 220 and the charge sharing switch unit 230 are simultaneously turned on. In detail, the short current path may be formed to include the first output buffer VH AMP, the charge sharing switch CSSW and the second output buffer VL AMP.

In an embodiment, the switch misoperation prevention unit 240 generates fourth to sixth control signals D_SW, C_SW and CS_SW which are to be provided to the output switch unit 220 and the charge sharing switch unit 230, by using the first to third control signals d_sw, c_sw and cs_sw provided from the control unit 250.

The switch misoperation prevention unit 240 generates the fourth to sixth control signals D_SW, C_SW and CS_SW such that the display driving circuit 200 may normally output pixel driving signals even when the control unit 250 misoperates due to power bouncing, or the like.

In an embodiment, the switch misoperation prevention unit 240 may be designed in such a manner that at least two control signals do not simultaneously have a level corresponding to a turned-on state. The switch misoperation prevention unit 240 may afford a highest priority to any one of the control signals for turning on the cross switches CSW1 and CSW2 and the direct switches DSW1 and DSW2, may afford a lowest priority to the control signal for turning on the charge sharing switch CSSW. That is to say, the turn-on times of the cross switches CSW1 and CSW2 and the turn-on times of the direct switches DSW1 and DSW2 for outputting pixel driving signals may be ensured independently, and the turn-on of the charge sharing switch CSSW may be prevented during the times for which the cross switches CSW1 and CSW2 and the direct switches DSW1 and DSW2 are turned on.

In an embodiment, the switch misoperation prevention unit 240 may afford priorities sequentially from the first control signal d_sw to the third control signal cs_sw, and may generate the fourth to sixth control signals D_SW, C_SW and CS_SW in such a way as to ensure that a signal with a relatively low priority is prevented from being turned on while a signal with a relatively high priority is turned on. It may be defined that a turn-on signal corresponds to a signal of a high level (a logic '1') for turning on a switch and a turn-off signal corresponds to a signal of a low level (a logic '0') for turning off a switch.

An embodiment may be designed to prevent the output switch unit 220 and the charge sharing switch unit 230 from being simultaneously turned on and thereby forming a short current path. In addition, the priority of applying pixel driving signals to the output terminals Odd Output and Even Output may be set to be higher than the priority of sharing charges between the output terminals Odd Output and Even Output. Meanwhile, priorities may be set in a manner different from above, according to an application of a product.

Namely, the output circuit 205 according to the embodiment may be configured such that switching corresponding to the panel charge/discharge period in which a pair of pixel driving signals are transmitted to the display panel and switching for charge sharing between the output terminals Odd Output and Even Output which output the pair of pixel driving signals are executed exclusively to each other.

Hereinbelow, descriptions will be made in detail by exemplifying the case where priorities are set in the order of the direct switches DSW1 and DSW2, the cross switches CSW1 and CSW2 and the charge sharing switch CSSW.

In an embodiment, the switch misoperation prevention unit 240 may output the fourth control signal D_SW by bypassing the first control signal d_sw, may generate the fifth control signal C_SW for controlling the cross switches CSW1 and CSW2, by processing the second control signal c_sw with the first control signal d_sw, and may generate the sixth control signal CS_SW for controlling the charge sharing switch CSSW, by processing the third control signal cs_sw with the fourth and fifth control signals D_SW and C_SW.

Figure 3:
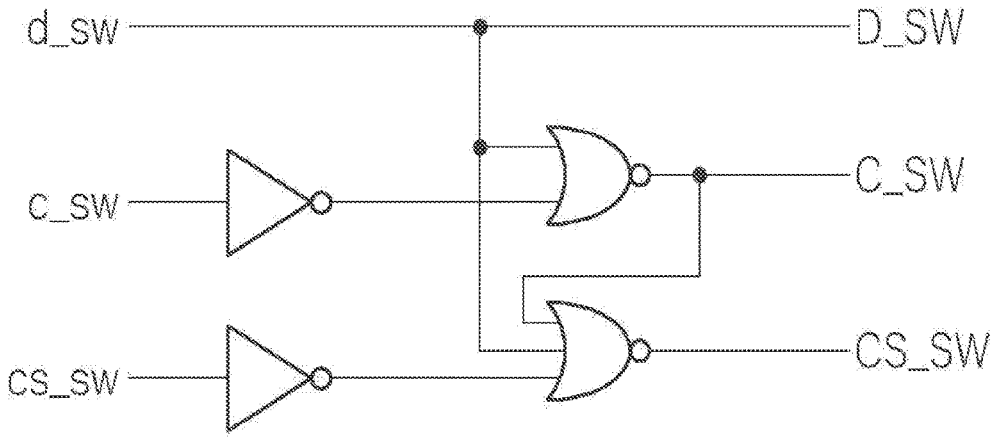
FIG. 3 is an exemplary diagram showing the configuration of a switch misoperation prevention unit shown in FIG. 2.
Figure 3:
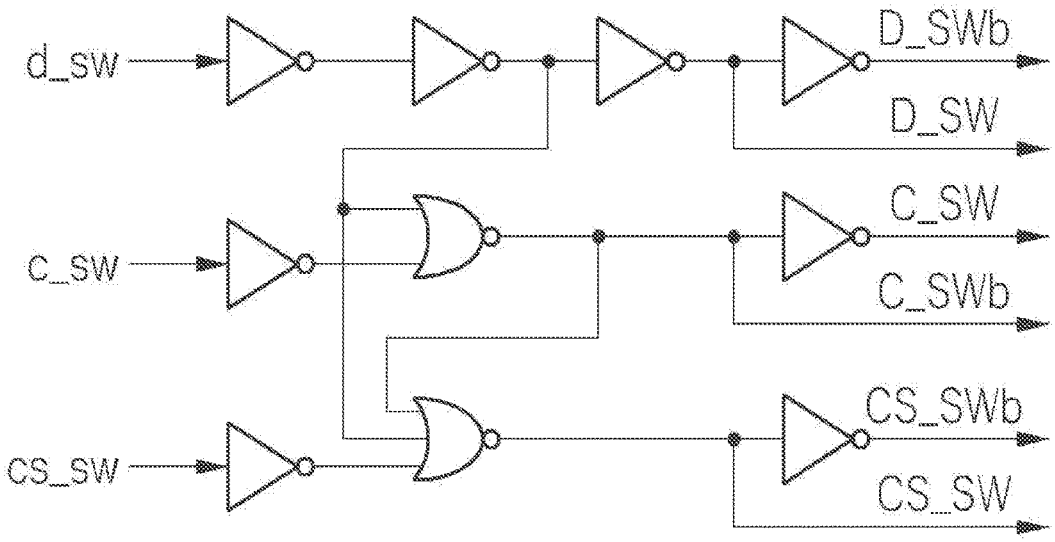

FIG. 3 is an exemplary diagram showing embodiments of the switch misoperation prevention unit 240 shown in FIG. 2.

Referring to (a) of FIG. 3, the switch misoperation prevention unit 240 may be realized by two NOT gates and two NOR gates.

The first row outputs the fourth control signal D_SW by bypassing the first control signal d_sw. The second row outputs the fifth control signal C_SW by NORing the result of NOTing the second control signal c_sw and the first control signal d_sw of the first row. The third row outputs the sixth control signal CS_SW by NORing the result of NOTing the third control signal cs_sw, the first control signal d_sw of the first row and the fifth control signal C_SW of the second row.

Operations of the switch misoperation prevention unit 240 realized in (a) of FIG. 3 may be represented as in the following Table 1.

TABLE 1

| | Inputs | | | Outputs | | |
|---|---|---|---|---|---|---|
| Class. | First control signal (d_sw) | Second control signal (c_sw) | Third control signal (cs_sw) | Fourth control signal (D_SW) | Fifth control signal (C_SW) | Sixth control signal (CS_SW) |
| Case 1 | 0 | 0 | 0 | 0 | 0 | 0 |
| Case 2 | 0 | 0 | 1 | 0 | 0 | 1 |
| Case 3 | 0 | 1 | 0 | 0 | 1 | 0 |
| Case 4 | 0 | 1 | 1 | 0 | 1 | 0 |
| Case 5 | 1 | 0 | 0 | 1 | 0 | 0 |
| Case 6 | 1 | 0 | 1 | 1 | 0 | 0 |
| Case 7 | 1 | 1 | 0 | 1 | 0 | 0 |
| Case 8 | 1 | 1 | 1 | 1 | 0 | 0 |

Referring to Table 1, the respective rows represent 8 cases that may occur according to combinations of the first to third control signals d_sw, c_sw and cs_sw inputted to the switch misoperation prevention unit 240. The three columns (the second to fourth columns) corresponding to inputs represent the levels of the first to third control signals d_sw, c_sw and cs_sw inputted to the switch misoperation prevention unit 240, and the three columns (the fifth to seventh columns) corresponding to outputs represent the levels of the fourth to sixth control signals D_SW, C_SW and CS_SW outputted according to results of processing in the switch misoperation prevention unit 240. The levels of the control signals are represented by a logic 0 and a logic 1 which respectively correspond to a low level for turning off a switch and a high level for turning on a switch.

Basically, when all the first to third control signals d_sw, c_sw and cs_sw correspond to 0 or only one control signal of the first to third control signals d_sw, c_sw and cs_sw corresponds to 1 (Cases 1, 2, 3 and 5), the switch misoperation prevention unit 240 outputs a control signal of the same level as a control signal inputted thereto.

When the levels of at least two control signals of the first to third control signals d_sw, c_sw and cs_sw correspond to 1, only a control signal with a higher priority retains the level 1. In detail, when the respective levels of the second and third control signals c_sw and cs_sw correspond to 1 (Case 4), the switch misoperation prevention unit 240 controls the levels of the fifth and sixth control signals C_SW and CS_SW outputted through processing, to 1 and 0, respectively. Referring to Case 4 and case 5, the switch misoperation prevention unit 240 outputs the fifth control signal C_SW to 1 in correspondence to the second control signal c_sw with a higher priority, and the state of the third control signal cs_sw with a lower priority is neglected and the output of the sixth control signal CS_SW is fixed to 0.

Similarly, when the respective levels of the first and third control signals d_sw and cs_sw correspond to 1 (Case 6), the switch misoperation prevention unit 240 may control the levels of the fourth and sixth control signals D_SW and CS_SW to 1 and 0, respectively, through processing. When the respective levels of the first and second control signals d_sw and c_sw correspond to 1 (Case 7), the switch misoperation prevention unit 240 may output only the level of the fourth control signal D_SW to 1, through processing. When all the levels of the first to third control signals d_sw, c_sw and cs_sw correspond to 1 (Case 8), the switch misoperation prevention unit 240 may output only the level of the fourth control signal D_SW to 1. In other words, when a control signal corresponding to an input with a higher priority is 1, the switch misoperation prevention unit 240 neglects the states of control signals corresponding to inputs with lower priorities, and outputs only a control signal corresponding to the control signal corresponding to the input with the higher priority, to 1.

Therefore, the switch misoperation prevention unit 240 may prevent the output switch unit 220 and the charge sharing switch unit 230 from being simultaneously turned on, through processing, and may enable pixel driving signals to be normally transmitted to the display panel even when the control unit 250 misoperates due to power bouncing.

In particular, in the case where the display driving circuit 200 is realized by a COG type IC, even when the bouncing of a second voltage related with the control signals occurs as the current generated by the operation of the IC passes through bonding resistance and LOG (line of glass) resistance, the display driving circuit 200 may normally output pixel driving signals to the display. Furthermore, since the formation of an internal short current path is prevented, the display driving circuit 200 may decrease power consumption and heat dissipation due to power noise.

While it was described in the embodiment that the switch misoperation prevention unit 240 is realized using NOT gates and NOR gates, it is to be noted that the embodiment is not limited to such and the switch misoperation prevention unit 240 may be realized by a combination of XOR gates or other processing gates.

If priorities are determined in the order of the cross switches CSW1 and CSW2, the direct switches DSW1 and DSW2 and the charge sharing switch CSSW, the switch misoperation prevention unit 240 may be realized to output the fifth control signal C_SW by bypassing the second control signal c_sw, generate the fourth control signal D_SW for controlling the direct switches DSW1 and DSW2, by processing the first control signal d_sw with the second control signal c_sw, and generate the sixth control signal CS_SW for controlling the charge sharing switch CSSW, by processing the third control signal cs_sw with the fourth and fifth control signals D_SW and C_SW.

Although the embodiment was described by affording specific priorities to respective switches, it is to be noted that the disclosure is not limited to such and priorities may be set differently according to an application of a product.

Referring to (b) of FIG. 3, the switch misoperation prevention unit 240 may be realized by two NOR gates and eight NOT gates.

The first row may be configured to output the fourth control signal D_SW by connecting in series four NOT gates, bypassing the first control signal d_sw and then inverting a bypassing result. The first row may be configured to further output an inverted signal D_SWb of the fourth control signal D_SW. The second row may be configured to output the fifth control signal C_SW by NORing a result of NOTing the second control signal c_sw and the first control signal d_sw of the first row and inverting a NORing result. The second row may be configured to further output an inverted signal C_SWb of the fifth control signal C_SW. The third row may be configured to output the sixth control signal CS_SW by NORing the NORing result of the second row, the first control signal d_sw of the first row and a result of NOTing the third control signal cs_sw. The third row may be configured to further output an inverted signal CS_SWb of the sixth control signal CS_SW.

The switch misoperation prevention unit 240 may be realized by high voltage elements since the level shifters 100 output signals of a high voltage region.

Figure 4:
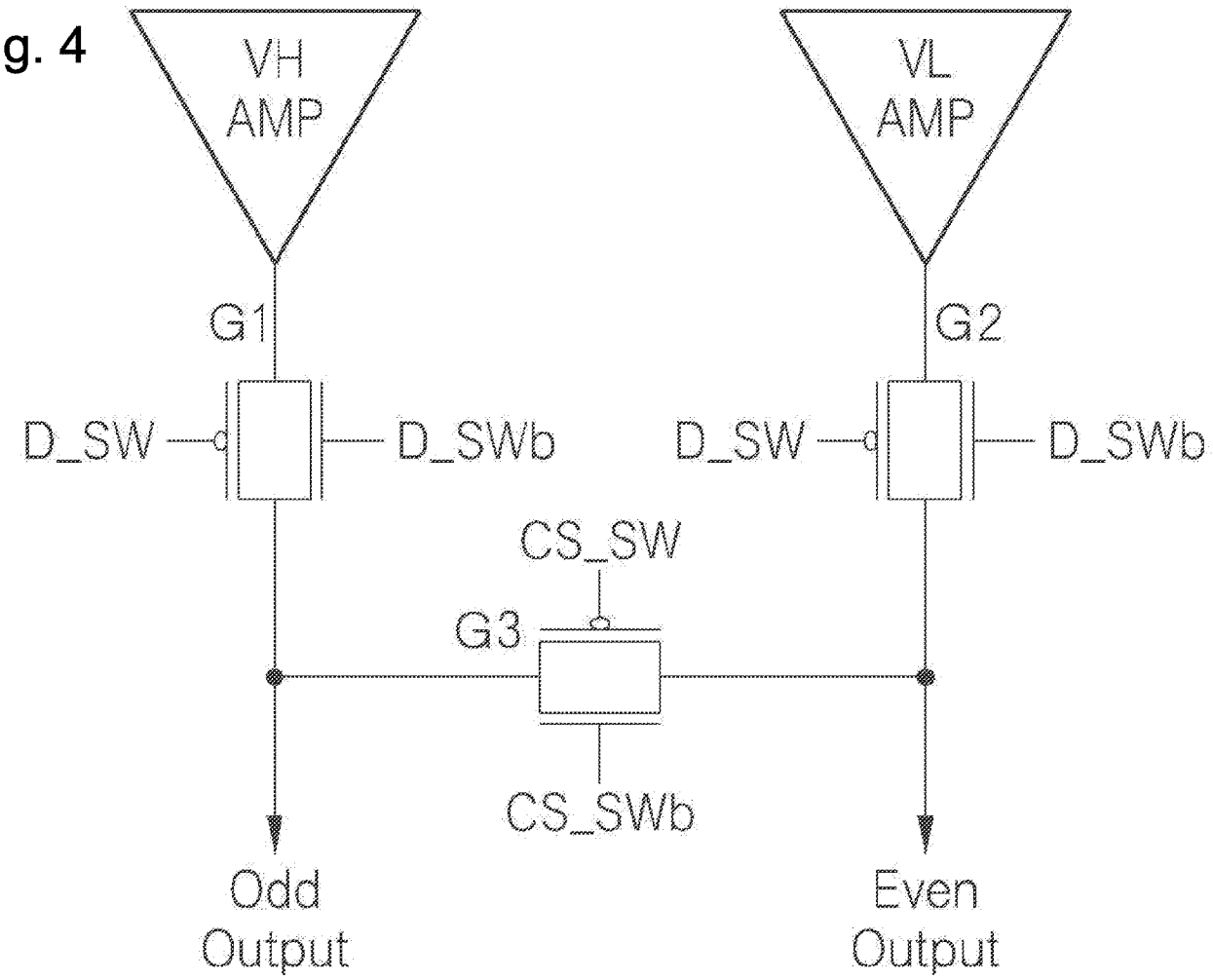
FIG. 4 is an exemplary diagram showing the configurations of an output switch unit and a charge sharing switch unit shown in FIG. 2.

FIG. 4 is an exemplary diagram schematically illustrating the output switch unit 220 and the charge sharing switch unit 230 shown in FIG. 2, to explain that the formation of an internal short path is prevented according to the embodiment.

Referring to FIG. 4, the switches disposed in the output switch unit 220 and the charge sharing switch unit 230 may be denoted as transmission gates G1 to G3 which are configured by combining NMOS transistors and PMOS transistors. The transmission gates G1 and G2 may be understood as direct switches.

In the embodiment, the switch misoperation prevention unit 240 may be configured as shown in (a) or (b) of FIG. 3, and as a result, may perform operations as explained with reference to Table 1.

That is to say, when the transmission gates G1 and G2 are turned on to transmit pixel driving signals to the output terminals Odd Output and Even Output, the transmission gate G3 is turned off. The reason to this resides in that, because the fourth control signal D_SW has a higher priority than the sixth control signal CS_SW, the sixth control signal CS_SW retains the logic 0 when the fourth control signal D_SW is logic 1.

Due to the correlations of the control signals as described above, in the embodiment of the disclosure, pixel driving signals may be normally outputted without forming an internal short path.

While various embodiments have been described above, it will be understood to those skilled in the art that the embodiments described are by way of example only. Accordingly, the disclosure described herein should not be limited based on the described embodiments.

What is claimed is:

1. A display driving circuit comprising:

an output switch unit configured to directly or crossly transmit a pair of pixel driving signals to a pair of output terminals:

a charge sharing switch unit configured to connect the pair of output terminals with each other:

a control unit including level shifters, and configured to generate a first control signal for directly transmitting the pair of pixel driving signals to the pair of output terminals, generate a second control signal for crossly transmitting the pair of pixel driving signals to the pair of output terminals, and generate a third control signal for connecting the pair of output terminals with each other, the first to third control signals are level-shifted by the level shifters; and a switch misoperation prevention unit configured to receive the first to third control signals from the control unit, generate first to third resultant signals for preventing misoperation of the output switch unit and the charge sharing switch unit by logically operating at least one or more of the first to third control signals and the second resultant signal, and provide a first to third resultant signals to the output switch unit and the charge sharing switch unit, wherein the switch misoperation prevention unit provides the first control signal for directly transmitting the pair of pixel driving signals to the pair of output terminals as the first resultant signal to direct switches of the output switch unit, provides the second resultant signal generated by logically operating the first control signal and the second control signal for crossly transmitting the pair of pixel driving signals to the pair of output terminals to cross switches of the output switch unit, and provides the third resultant signal generated by logically operating the first control signal, the second resultant signal and the third control signal for connecting the pair of output terminals with each other to the charge sharing switch unit, wherein the, switch misoperation prevention unit is configured to prevent first to third resultant signals from simultaneously having a same level corresponding to a turn-on state, when the first to third control signals level-shifted by the level shifters are received at the same level, and wherein the switch misoperation prevention unit is further configured to prioritize sequentially from the first control signal to the third control signal and is configured to generate the first, to the third resultant signal, to ensure that a signal with a low priority is prevented from being turned on while a signal with a high priority is turned on, wherein the switch misoperation prevention unit comprises:

a NOT gate buffering the first control signal and outputting the first resultant signal; a first NOR gate performing a NOR operation of the first control signal and an inverted signal of the second control signal and outputting the second resultant signal;

a second NOR gate performing a NOR operation of the first control signal, the second resultant signal, and an inverted signal of the third control signal and outputting the third resultant signal.

2. The display driving circuit according to claim 1, wherein the control unit comprises:

level shifters configured to output the first control signal to the third control signal of which levels are shifted from a low voltage region to a high voltage region.

3. The display driving circuit according to claim 1, wherein the output switch unit comprises the direct switches configured to directly connect the pair of pixel driving signals to the pair of output terminals and the cross switches configured to crossly connect the pair of pixel driving signals to the pair of output terminals, wherein the charge sharing switch unit comprises the charge sharing switch configured to connect the pair of output terminals with each other, and wherein the switch misoperation prevention unit processes the first control signal to the third control signal for respectively controlling operations of the direct switches, the cross switches and the charge sharing switch, and outputs the first resultant signal to the third resultant signal such that they have exclusive switching relationships.

4. The display driving circuit according to claim 1, wherein the switch misoperation prevention unit affords priorities to the first control signal to the third control signal for controlling the output switch unit and the charge sharing switch unit, and processes only a control signal with a highest priority of the first control signal to the third control signal in such a way as to have a value for turn-on according to the priorities.

5. The display driving circuit according to claim 1, wherein the switch misoperation prevention unit further generates signals with polarities opposite to the respective first resultant control signal to the third resultant control signal.

6. A display driving circuit comprising:

an output switch unit configured to directly or crossly transmit a pair of pixel driving signals to a pair of output terminals;

a charge sharing switch unit configured to connect the pair of output terminals with each other;

a control unit including level shifters, and configured to generate a first control signal for directly transmitting a pair of pixel driving signals to a pair of output terminals, generate a second control signal for crossly transmitting the pair of pixel driving signals to the pair of output terminals, and generate a third control signal for connecting the pair of output terminals with each other, the first to third control signals are level-shifted by the level shifters; and a switch misoperation prevention unit, when at least two or more of the first control to the third control signal simultaneously have a value corresponding to turn-on, configured to process only a control signal with a highest priority of the at least two or more of the first control to the third control signal to have the value corresponding to turn-on, process remaining control signals with lower priorities to have a value corresponding to turn-off, and provide processing resultant signals to force exclusive switching between the output switch unit and the charge sharing switch unit, wherein the switch misoperation prevention unit receives the first to third control signals from the control unit, generates a first to third resultant signals for preventing misoperation of the output switch unit and the charge sharing switch unit by logically operating at least one or more of the first to third control signals and the second resultant signal, and provides a first to third resultant signals for exclusive switching control to the output switch unit and the charge sharing switch unit, and wherein the switch misoperation prevention unit provides the first control signal for directly transmitting the pair of pixel driving signals to the pair of output terminals as the first resultant signal to direct switches of the output switch unit, provides the second resultant signal generated by logically operating the first control signal and the second control signal for crossly transmitting the pair of pixel driving signals to the pair of output terminals to cross switches of the output switch unit, and provides the third resultant signal generated by logically operating the first control signal, the second resultant signal and the third control signal for connecting the pair of output terminals with each other to the charge sharing switch unit, wherein the switch misoperation prevention unit, is configured to prevent first to third resultant signals from simultaneously having a same level corresponding to a turn-on state, when the first to third control signals level-shifted by the level shifters are received at the same level, and wherein the switch misoperation prevention unit is further configured to prioritize sequentially from, the first control signal to the third control signal and is configured to generate the first to the third resultant signal to ensure that a signal with a low priority is prevented from being turned on while a signal with a high priority is turned on, wherein the switch misoperation prevention unit comprises:

a NOT gate buffering the first control signal and outputting the first resultant signal; a first NOR gate performing a NOR operation of the first control signal and an inverted signal of the second control signal and outputting the second resultant signal;

a second NOR gate performing a NOR operation of the first control signal, the second resultant signal, and an inverted signal of the third control signal and outputting the third resultant signal.

7. The display driving circuit according to claim 6, wherein the first control to the third control signal are set priority, the switch misoperation prevention unit configured to process control signals with lower priorities to have a value corresponding to turn-off when a control signal with a higher priority has a value corresponding to turn-on.

8. The display driving circuit according to claim 6, further comprising:

the direct switches configured to directly transmit the pair of pixel driving signals to the pair of output terminals; and the cross switches configured to crossly transmit the pair of pixel driving signals to the pair of output terminals, wherein the direct switches and the cross switches perform operations for a switching, and priorities are set between control signals corresponding to the direct switches and the cross switches.

9. The display driving circuit according to claim 6, wherein the switch misoperation prevention unit outputs a control signal with a highest priority by bypassing it, and processes and outputs remaining control signals in such a way as to have a value corresponding to turn-off when the control signal with the highest priority has a value corresponding to turn-on.

* * * * *